United States Patent [19]

Kowalczyk et al.

[11] Patent Number: 4,998,758

[45] Date of Patent: Mar. 12, 1991

[54] LOW EFFORT REMOTE LATCH ACTUATOR

[75] Inventors: David Kowalczyk, Sterling Heights; Ian J. Dow, Royal Oak; Carl D. May, Farmington Hills, all of Mich.

[73] Assignee: General Motors Corporation, Detroit, Mich.

[21] Appl. No.: 521,855

[22] Filed: Apr. 10, 1990

[51] Int. Cl.[5] ..... E05C 3/26

[52] U.S. Cl. ..... 292/201; 292/DIG. 25; 292/DIG. 62; 292/DIG. 43; 292/216

[58] Field of Search ..... 292/DIG 25, DIG. 14, 292/DIG. 62, DIG. 43, 201, 336.3, 216; 74/471 R

[56] References Cited

U.S. PATENT DOCUMENTS

| | | | |
|---|---|---|---|
| 3,504,511 | 4/1970 | Allen | 292/DIG. 62 |
| 3,596,957 | 8/1971 | Gionet | 292/341.16 |
| 4,093,289 | 6/1978 | Inabayashi et al. | 292/DIG. 62 |
| 4,312,197 | 1/1982 | Carrlon et al. | 292/DIG. 14 |
| 4,364,249 | 12/1982 | Kleefeldt | 292/DIG. 25 |
| 4,478,441 | 10/1984 | Fiordellisi et al. | 292/DIG. 25 |
| 4,518,182 | 5/1985 | Cousin et al. | 292/DIG. 14 |
| 4,811,620 | 3/1989 | Old et al. | 74/471 R |
| 4,906,033 | 3/1990 | Nagai et al. | 292/341.16 |
| 4,917,418 | 4/1990 | Gokee | 292/DIG. 25 |
| 4,962,955 | 10/1990 | Ferrara et al. | 292/216 |

*Primary Examiner*—Eric K. Nicholson

*Attorney, Agent, or Firm*—Charles E. Leahy

[57] ABSTRACT

A remote release actuating system for a deck lid latch includes an actuator lever pivotally mounted on the latch so that pivotal movement on the actuator lever unlatches the latch. At least a first and second remote actuatable actuator means are respectively coupled to the actuator lever by first and second lost motion coupling mechanisms so that the operator actuation of either one of the first and second operator actuatable actuator means pivots the actuator lever about the pivot means to unlatch the latch while the other of the first and second remote actuatable actuator means remains unactuated and free of any backdrive effort being imposed thereon. Accordingly, the effort required to effect a remote release of the deck lid latch is minimized.

1 Claim, 2 Drawing Sheets

LOW EFFORT REMOTE LATCH ACTUATOR

The invention relates to an automobile deck lid latch and more particularly to a deck lid latch releasable by multiple remote actuators to allow the deck lid to spring to an open position.

BACKGROUND OF THE INVENTION

It is well known in motor vehicles to provide a deck lid panel for closing a luggage compartment. The deck lid panel is mounted on the vehicle body by hinges. A spring lifts the deck lid panel to an open position.

A deck lid latch is conventionally provided to engage with a striker for latching the deck lid in the closed position. The deck lid latch conventionally includes a fork bolt engageable with the striker and a detent lever for latching the fork bolt at a latched position with respect to the striker to capture the striker within the latch and thereby latch the deck lid panel in the closed position.

It is well known in the prior art to release the deck lid latch by pivoting the detent lever to an unlatched position with respect to the fork bolt. The detent lever may be pivoted by a key operated lock cylinder. It is also known to remotely actuate the deck lid latch by mounting an electrical solenoid on the latch with the solenoid connected with the detent lever so that energization of the solenoid pivots the detent lever to the unlatching position.

It would be desirable to provide an improved deck lid remote release mechanism in which the actuation of any one of a plurality of remote actuators would release the latch without back driving the other remote actuators to thereby lessen the effort required to release the latch.

SUMMARY OF THE INVENTION

According to the invention a remote release actuating system for a deck lid latch includes an actuator lever pivotally mounted on the latch so that pivotal movement on the actuator lever unlatches the latch. At least a first and second remote actuatable actuator means are respectively coupled to the actuator lever by first and second lost motion coupling mechanisms so that the operator actuation of either one of the first and second operator actuatable actuator means pivots the actuator lever about the pivot means to unlatch the latch while the other of the first and second remote actuatable actuator means remains unactuated and free of any back-drive effort being imposed thereon. Accordingly, the effort required to effect a remote release of the deck lid latch is minimized.

Accordingly, one object, feature and advantage of the invention resides in the provision of a remote actuating arrangement for a deck lid in which the remote operator actuation of any one of a plurality of a remote actuators releases the latch without back driving any of the other remote actuators so as to minimize the effort required to obtain a remote release actuation.

A further object, feature and advantage of the invention resides in the provision of lost motion connection means connecting each of a plurality of remote actuators to a deck lid latch so that the actuation of any one of the other remote actuators does not back drive any of the remote actuators.

A further object, feature and advantage resides in the provision of a deck lid latch having a solenoid operated release mechanism coupled to the latch by a mechanical lost motion connection so that remote actuation of the latch by a mechanical remote operator does not back-drive the solenoid.

These and other features, objects and advantages of the invention will become apparent upon consideration of the description of the preferred embodiment and the appended drawings in which:

DESCRIPTION OF THE PREFERRED EMBODIMENT

Figure 1:
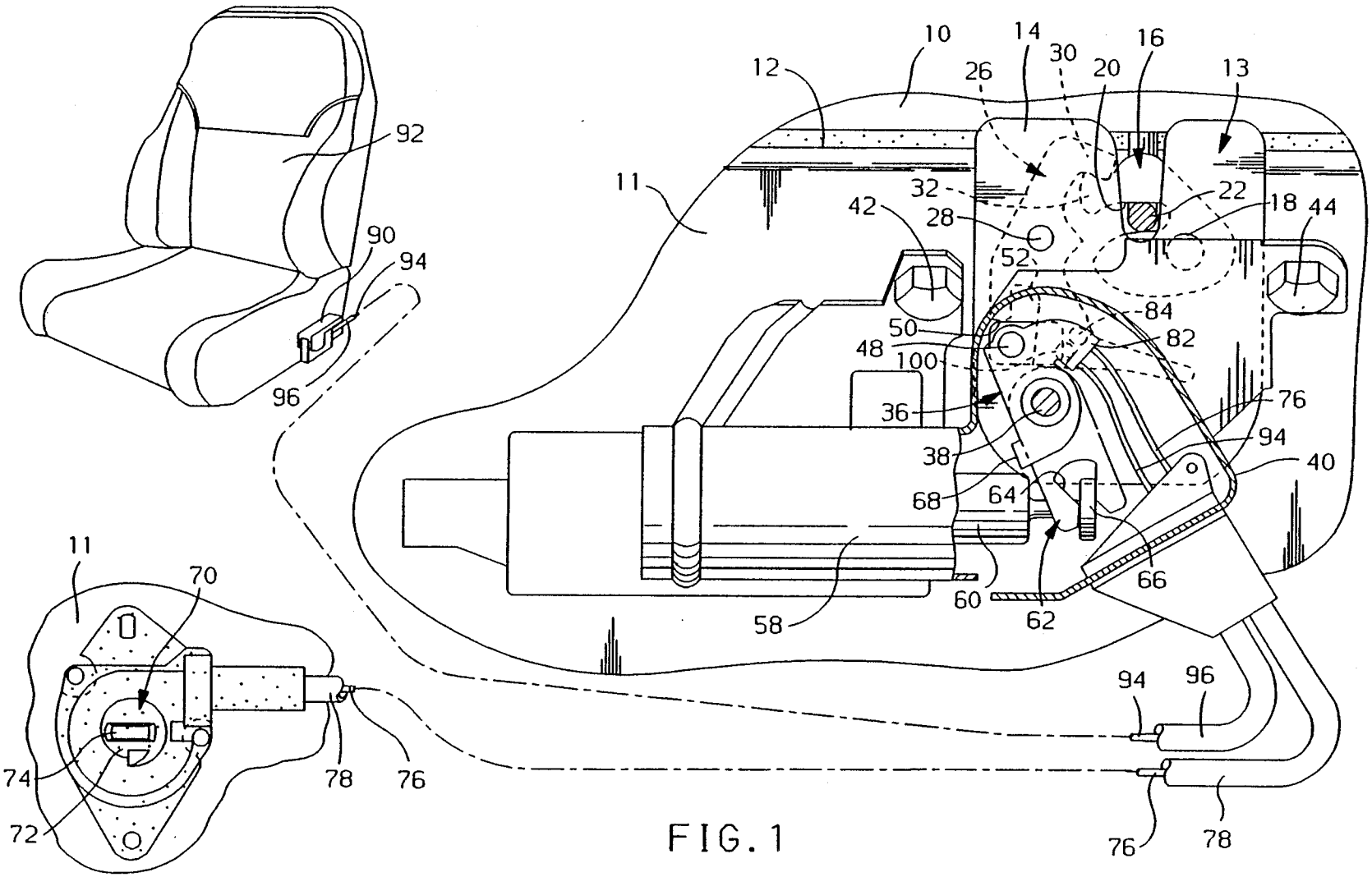
FIG. 1 is an elevation view of a deck lid latch according to the invention and having a solenoid electrical release, a first mechanical remote actuator mounted adjacent the occupant seat, and a second remote actuator operated by a key cylinder mounted on the vehicle body.

Referring to FIG. 1, a deck lid closure panel of a vehicle body is indicated at 10. The closure panel 10 is hingedly mounted on the vehicle body for movement between open and closed positions with respect to a vehicle compartment. The closure panel 10 is spring loaded for movement to the open position.

FIG. 1 also shows a body panel 11 which defines the compartment opening 12 selectively opened and closed by the closure panel 10.

The closure panel 10 is latched in the closed position by a latch assembly, generally indicated at 13. The latch assembly 13 includes a housing 14 having a latch bolt 16 mounted thereon by pivot 18. The latch bolt 16 has an opening 20 by which the latch bolt 16 is engageable with a striker rod 22 carried by the closure panel 10 to latch and interconnect the closure panel 10 with the body panel 11. The latch assembly 13 includes a spring, not shown, which biases the latch bolt to an unlatched position in the clockwise direction from the latched position shown in FIG. 1.

As shown in FIG. 1, the latch assembly 13 includes a detent lever 26 mounted on the housing 14 by pivot 28 and has a hook 30 which engages with a hook 32 of the latch bolt 16 to hold the latch bolt 16 in the latched position with respect to the striker 22. A spring, not shown, urges the detent lever 26 to the latched position of FIG. 1.

A remote actuating mechanism is provided for operating latch assembly 13. In particular, as seen in FIG. 1, an actuator lever 36 is pivotally mounted on the latch housing 14 by a pivot pin 38. This pivot pin is advantageously mounted via an auxiliary housing 40 which overlies the latch assembly 13 and is attached to body panel 11 by bolts 42 and 44. The actuator lever 36 has a actuator pin 48 which reaches through an access opening 50 in the latch housing 14 to engage with an abutment face 52 of the detent lever 26. Accordingly, clockwise rotation of the actuator lever 36 about the pivot 38 from the position of FIG. 1 to the positions of FIGS. 2 and 3 cause the actuator pin 48 to rotate the detent lever 26 in the counterclockwise direction of rotation about its pivot pin 28 to disengage the detent lever 26 from the fork bolt 16.

A remote electric actuator is provided for operating the actuator lever 36. In particular, a solenoid coil 58 is mounted on the auxiliary housing 40 and has plunger 60 which, has a normal extended position as shown in FIG. 1 but is retracted leftwardly upon energization of the coil 58. The plunger 60 is connected to the actuator lever 36 by an auxiliary lever 62 which is also pivotally mounted on the pivot pin 38. The auxiliary lever 62 has a slot 64 which captures a head 66 of the plunger 60 so that the leftward and rightward movement of the plunger 60 pivots the auxiliary lever 62 about the pivot pin 38. The actuator lever 36 has an integral tab 68 bent therefrom which reaches into the path of clockwise rotational movement of the auxiliary lever 62 so that leftward movement of the plunger 60 and consequent clockwise rotation of the auxiliary lever 62 causes the actuator lever 36 to also rotate clockwise to carry pin 48 into engagement with the detent lever 26, thereby releasing the latch assembly.

A key operated cylinder is also connected to the actuator lever 36. In particular, as seen in FIG. 1, a key cylinder assembly, generally indicated at 70, is mounted on the vehicle body panel 11 remote from the latch assembly 13 and includes a cylinder 72 which may be rotated upon the insertion of a properly bitted key into key slot 74. A cable 76 housed in sheath 78 is attached to the cylinder 72 so that a counterclockwise rotation of the cylinder 72 by the key 74 retracts the cable 76 leftwardly. The cable 76 is communicated through the auxiliary housing 40 and extends through an aperture 80 provided in a lateral tab 82 bent from the actuator lever 36. A ball 84 is swaged onto the cable 76 and engages with the tab 82 upon leftward movement of the cable 76 so that the actuator lever 36 is rotated in the clockwise direction about its pivot 38 to unlatch the latch assembly 13. During this rotation of the actuator lever 36 by the cable 76, the tab 68 of the actuator lever 36 is carried away from the auxiliary lever 62 which remains at rest so that the plunger 60 is not moved during remote actuation of the actuator lever 36 by the key operated cable 76.

Figure 3:
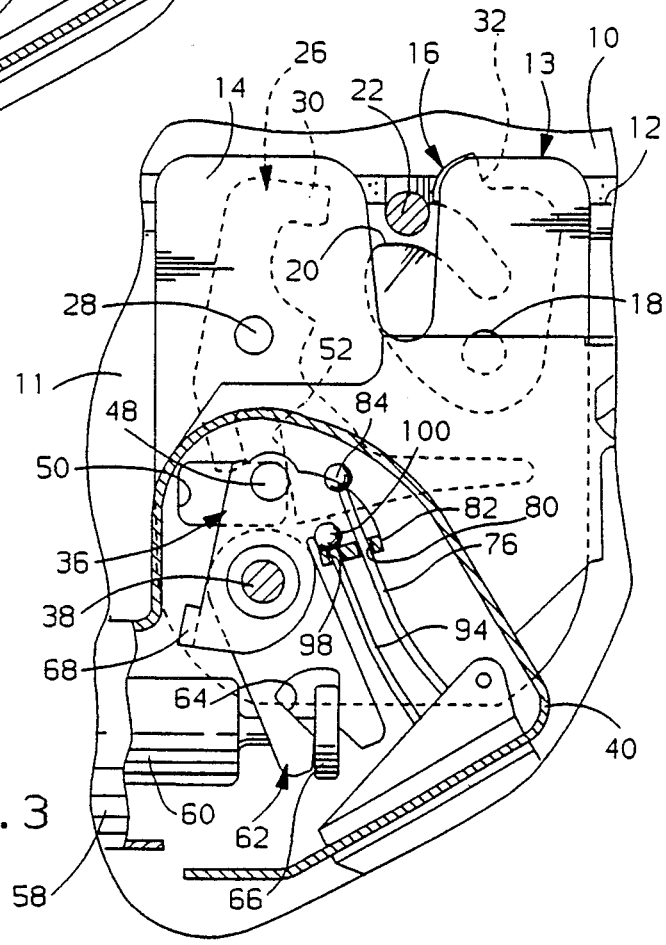
FIG. 3 is a view similar to FIG. 2 but showing the deck lid latch being unlatched by a remote mechanical actuation while the solenoid remains at rest.

FIG. 1 also shows a remote actuating handle 90 located adjacent the occupant seat 92. The handle 90 is connected to the latch assembly by a cable 94 housed in sheath 96. The cable 94 extends through an aperture 98 in the lateral tab 82 of the actuator lever 36. A ball 100 is swaged onto the end of cable 94 and engages with the tab 82 upon leftward movement of the cable 94 upon actuation of handle 90. As seen in FIG. 3, the actuation of handle 90 and leftward movement of cable 94 rotates the actuator lever 36 in the clockwise direction to carry actuator pin 48 into latch releasing engagement with the detent lever 26. It is also seen that this clockwise rotation of the actuator lever carries the actuator tab 68 away from the auxiliary lever 62 so that the solenoid 60 is permitted to remain at rest during the remote mechanical actuation of the release by the cable 94.

Figure 2:
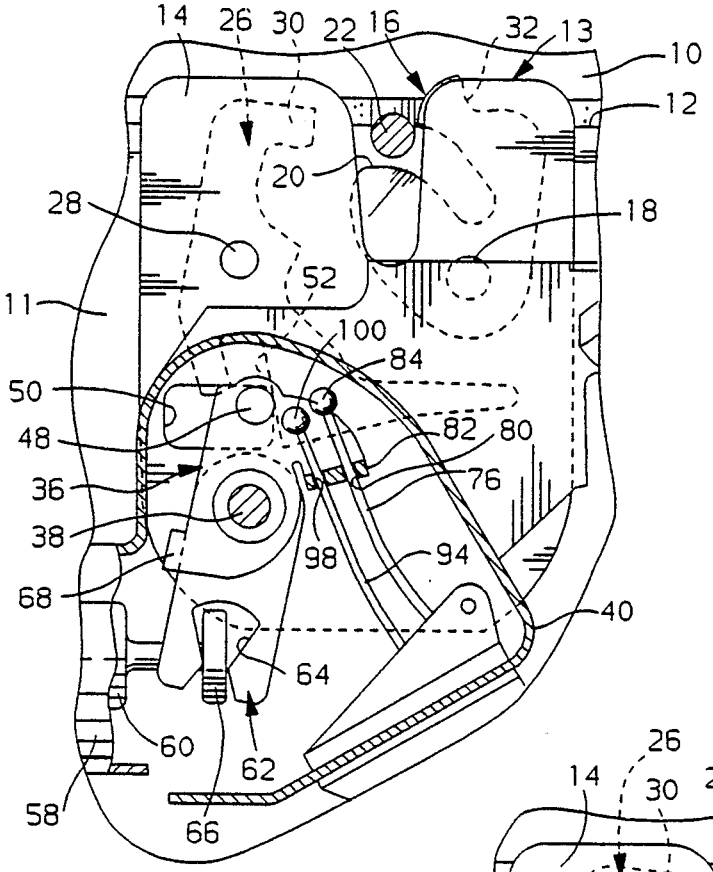
FIG. 2 is fragmentary elevation view similar to FIG. 1 but showing the deck lid latch being unlatched by remote actuation of the solenoid.

In comparing FIGS. 2 and 3 it will be appreciated that the actuation of the actuator lever 36 by either one of the cables 76 and 94 permits the other cable to remain at rest by slipping through the aperture in the lateral tab 80.

Accordingly, it is seen that each of the remote actuators, that is, the solenoid plunger 60, the cable 94, and the cable 76, are connected to the actuator lever 36 by a lost motion connection so that the actuation of any one of these remote actuators is effective to rotate the actuator lever while permitting the other of the remote actuators to remain at rest. In this way, none of the remote actuators back drives any of the others so that the effort required to release the latch is minimized.

It will be appreciated that the solenoid coil 58 may be energized by any suitable remote electrical actuating device, such as an electrical switch or a wireless radio or infra-red transmitter.

Thus it is seen that the invention provides a new and improved remote actuating arrangement for a vehicle deck lid latch.

The embodiments of the invention in which an exclusive property or privilege is claimed are defined as follows:

1. An actuator for the release of a motor vehicle latch from a plurality of remote locations, comprising:

an actuator lever operatively associated with the latch for releasing the latch;

pivot means mounting the actuator lever so that pivotal movement of the actuator lever in one direction releases the latch;

an auxiliary lever mounted on the pivot means, electric motor means connected to the auxiliary lever to pivot the auxiliary lever in the one direction upon remote energization of the electric motor means;

abutment means acting between the levers so that pivotal movement of the auxiliary lever in the one direction by the electric motor means causes pivotal movement of the actuator lever to release the latch and pivotal movement of the actuator lever in the one direction about the pivot means permits the auxiliary lever to remain at rest so that the electric motor means is not backdriven by pivoting movement of the actuator lever;

first and second cable means independently remotely actuable, and first and second lost motion connection means respectively connecting the first and second cable means with the actuator lever by which either one of the first and second cable means may rotate the actuator lever in the one direction while the other of the cable means and the auxiliary lever coupled to the electric motor means remain at rest and are not backdriven.

* * * * *